US007634891B2

(12) United States Patent
Fanucci et al.

(10) Patent No.: US 7,634,891 B2
(45) Date of Patent: Dec. 22, 2009

(54) HYBRID BEAM AND STANCHION INCORPORATING HYBRID BEAM

(75) Inventors: Jerome P. Fanucci, Lexington, MA (US); Michael McAleenan, Georgetown, ME (US); Thomas Heimann, Bedford, MA (US); Kirk E. Survilas, Peabody, MA (US)

(73) Assignee: Kazak Composites, Inc., Woburn, MA (US)

( * ) Notice: Subject to any disclaimer, the term of this patent is extended or adjusted under 35 U.S.C. 154(b) by 551 days.

(21) Appl. No.: 11/223,454

(22) Filed: Sep. 9, 2005

(65) Prior Publication Data

US 2006/0070340 A1 Apr. 6, 2006

Related U.S. Application Data

(60) Provisional application No. 60/608,400, filed on Sep. 9, 2004, provisional application No. 60/614,540, filed on Sep. 30, 2004.

(51) Int. Cl.
*E04C 3/00* (2006.01)

(52) U.S. Cl. ..... 52/843; 52/839; 52/841; 52/834

(58) Field of Classification Search ..... 52/836, 52/843, 729.1, 837, 309.7, 309.14, 834, 839, 52/841, 847
See application file for complete search history.

(56) References Cited

U.S. PATENT DOCUMENTS

| | | | | |
|---|---|---|---|---|
| 3,331,174 | A * | 7/1967 | Wesch et al. | 52/309.11 |
| 4,342,144 | A * | 8/1982 | Doguchi | 29/897.312 |
| 4,580,380 | A * | 4/1986 | Ballard | 52/309.9 |
| 5,678,381 | A * | 10/1997 | DenAdel | 52/836 |
| 5,689,922 | A * | 11/1997 | Daudet | 52/210 |
| 6,494,012 | B2 * | 12/2002 | Seng | 52/841 |
| 6,505,454 | B2 * | 1/2003 | Dingler | 52/842 |
| 6,519,911 | B1 * | 2/2003 | Sawada | 52/842 |
| 2002/0053179 | A1 * | 5/2002 | Wycech | 52/721.4 |
| 2008/0050578 | A1 * | 2/2008 | Sinclair, Sr. | 428/318.4 |

* cited by examiner

*Primary Examiner*—Richard E Chilcot, Jr.
*Assistant Examiner*—Anthony N Bartosik
(74) *Attorney, Agent, or Firm*—Weingarten, Schurgin, Gagnebin & Lebovici LLP

(57) ABSTRACT

A hybrid metal/composite material beam is suitable for withstanding bending stresses. The hybrid beam is a combination of dissimilar materials that are geometrically optimized in a structure to provide benefits beyond the characteristics of the materials separately. Also a stanchion assembly incorporates the hybrid beam.

9 Claims, 13 Drawing Sheets

HYBRID BEAM AND STANCHION INCORPORATING HYBRID BEAM

CROSS REFERENCE TO RELATED APPLICATIONS

This application claims benefit under 35 U.S.C. § 119(e) of U.S. Provisional Patent Application No. 60/608,400, filed on Sep. 9, 2004, and U.S. Provisional Application No. 60/614,540, filed on Sep. 30, 2004, the disclosures of both of which are incorporated by reference herein.

STATEMENT REGARDING FEDERALLY SPONSORED RESEARCH OR DEVELOPMENT

N/A

BACKGROUND OF THE INVENTION

In some applications, structural elements may be subject to single or repeated loads, such as hammer blows. Metal has good impact resistance and ductility and thus can be designed to tolerate such loads. Metals are heavy, however. Composite materials have been used in various structural applications to reduce weight. Composite materials, however, have lesser impact resistance and ductility and are not good choices for beams subjected to bending stresses in environments that are also subject to single or repeated impact loading.

SUMMARY OF THE INVENTION

The present invention relates to a hybrid metal/composite material beam for withstanding bending stresses. The hybrid beam is a combination of dissimilar materials that are geometrically optimized in a structure to provide benefits beyond the characteristics of the materials separately.

More particularly, the hybrid beam includes a metal beam component extending in a longitudinal direction from one end to another end. The metal beam comprises at least one web element extending longitudinally and at least one flange element extending longitudinally and connected to the web element. At least one of the web element and the flange element is configured to form an enclosure. A composite material component comprising a filler element for stiffening and/or strengthening the beam is disposed within the enclosure and comprised of a fibrous material embedded in a matrix material. The enclosure covers at least a portion of an externally facing surface of the composite material component.

The present invention also relates to a stanchion assembly incorporating the present hybrid beam. The stanchion assembly includes a biasing mechanism at one end so that the beam can be retained in a vertical orientation between a floor and a ceiling.

DETAILED DESCRIPTION OF THE INVENTION

The present invention provides a hybrid metal/composite material structural beam. A beam is a structural element long in proportion to its depth and width and designed to bear bending or flexural stresses along all or part of its length. A beam typically includes one or more web elements and one or more flange elements when viewed in a cross-section taken along a plane transverse to the long axis of the beam.

The hybrid beam of the present invention is a combination of dissimilar materials that are geometrically optimized in a structure to provide benefits beyond the characteristics of the materials separately. The beam of the present invention includes a metal component and a composite material component, which together bear the loads on the beam. The metal component includes at least one web element and at least one flange element. One or more of the metal web elements and the metal flange elements form enclosures in which the composite material components reside. The composite material component is a web filler element and/or a flange filler element. The web filler element and flange filler element impart stiffness and/or strength to the beam while allowing a reduction in the weight of the beam as compared to an all-metal beam designed to the same load specifications. The metal component wraps around or covers some or the entire outer surface of the composite material component, thereby providing protection against impact to the composite material component of the beam.

The metal component can be fabricated from any suitable metal or metal alloy, such as, without limitation, aluminum or stainless steel. The composite material component is fabricated from a fibrous material embedded in a matrix material. The fibrous material and the matrix material can be any suitable materials. Suitable fibrous materials include, without limitation, carbon, glass, or aramid, such as Kevlar®, fibers. Suitable matrix materials include, without limitation, polyester, vinyl ester, epoxy, phenolic or polyurethane resins, although other materials can be used. In one exemplary embodiment, the combination of an aluminum extrusion and carbon fiber reinforced composite material geometrically optimized for a beam provides the impact resistance of aluminum and significantly increased beam stiffness due to the carbon fibers.

Figures 1A, 1B, 1C:
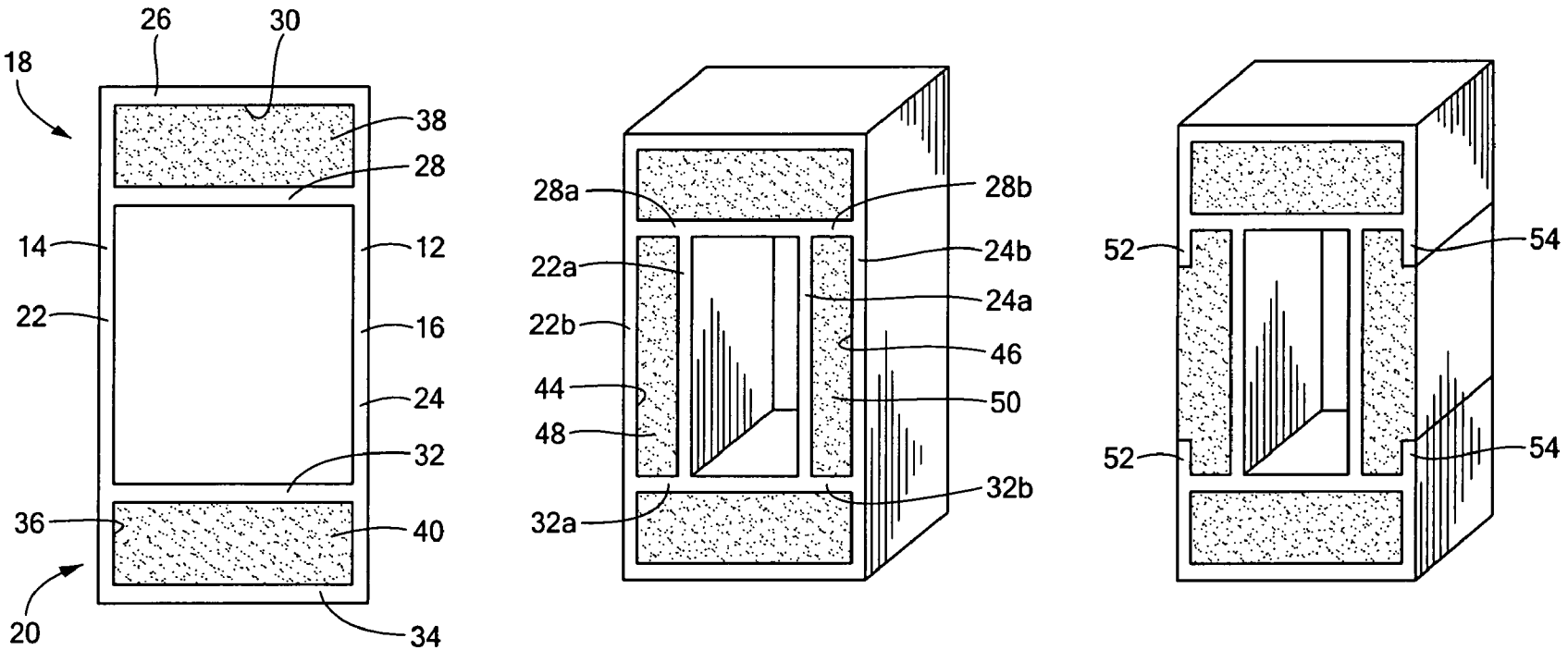
FIG. 1A schematically illustrates an end view of a hybrid beam of the present invention having composite material flange filler elements in metal flange enclosures.
FIG. 1B schematically illustrates an isometric view of the hybrid beam of FIG. 1A further including composite material web filler elements in metal web enclosures.
FIG. 1C schematically illustrates an isometric view of the hybrid beam of FIG. 1A further including composite material web filler elements in metal web enclosures having an exterior opening therein.

FIGS. 1A through 1D illustrate several embodiments of a beam in which upper and lower metal flange elements form enclosures for composite material flange filler elements. FIG. 1A illustrates a first embodiment of a beam having a generally box-like or rectangular cross section. The beam's metal component 12 has two web elements 14, 16, an upper flange element 18, and a lower flange element 20. The web elements each have one metal web or depth member 22, 24. The upper flange element 18 includes two metal flange members 26, 28 extending between the two metal web elements to form an upper flange enclosure 30. The lower flange element 20 similarly includes two metal flange members 32, 34 extending between the metal web elements to form a lower flange enclosure 36.

An upper flange filler element 38 of a composite material is inserted in the upper flange enclosure 30, in contact with the metal inwardly facing surfaces. A lower flange filler element 40 of a composite material is inserted in the lower flange enclosure 36, in contact with the metal inwardly facing surfaces. The flange filler elements can be press fit or slid into the enclosures from the ends of the beam. Alternatively, the composite material component and the metal component can be co-extruded. For example, a metal extrusion, such as of aluminum, can be inserted into a pultrusion die for the composite material. The flange filler elements are further attached to the metal surfaces in any suitable manner, such as with a suitable adhesive.

FIG. 1B illustrates a further embodiment similar to FIG. 1A, and in which the metal web elements further include inner web members 22*a*, 24*a*. The inner web members and outer web members 22*b*, 24*b*, and portions 28*a*, 28*b*, 32*a*, 32*b*, of the flange elements form web enclosures 44, 46 in which web filler elements 48, 50 from a composite material are inserted.

FIG. 1C illustrates a further embodiment similar to FIG. 1B. In this embodiment, the outer metal web members between the flange elements are not present. Optionally, metal extensions or tabs 52, 54 may extend inwardly from the upper and lower flange elements. The inner web members and inwardly facing surfaces of the upper and lower flange elements form enclosures for web filler elements. The extensions if present help to hold the web filler elements in place in the enclosures while the adhesive between the filler elements and the metal dries.

The web filler elements can be press fit or slid into place as described above, or they can be snapped into the web enclosures by pressing them past the extensions if present. In the case of snapping into place, the extensions are spring-like and flexible and thus bend sufficiently to allow the filler elements to pass by. When the filler element is in place in the enclosure, the extensions snap back into place as shown in the figure, thereby holding the filler elements within the enclosures. It will be appreciated that the spring-like extensions are generally thinner than the web and flange members, although they are shown having the same thickness in the figures.

Figure 1D:
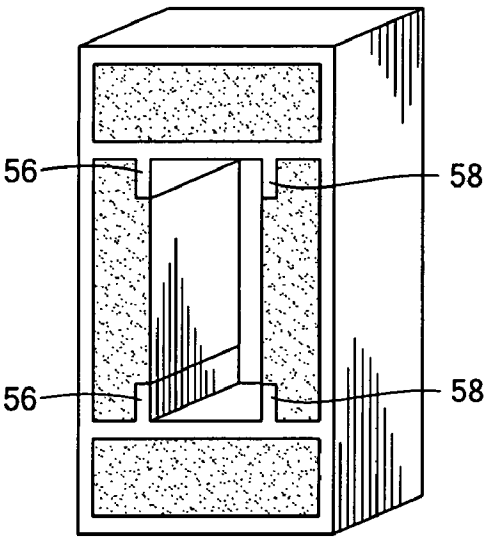
FIG. 1D schematically illustrates an isometric view of the hybrid beam of FIG. 1A further including composite material web filler elements in metal web enclosures having an interior opening therein.

FIG. 1D illustrates a further embodiment similar to FIG. 1B in which the inner web members between the upper and lower flange elements are not present. Optionally, extensions 56, 58 may extend inwardly from the upper and lower flange elements. The outer web members and inwardly facing surfaces of the upper and lower flange elements form enclosures for web filler elements. The extensions if present help to hold the web filler elements in place in the enclosures while the adhesive dries. As with the embodiment of FIG. 1C, the web filler elements can be slid or press fit into place, or they can be snapped into the web enclosures by pressing them past the extensions if present. In the case of snap fitting into place, the extensions are spring-like and flexible and thus bend sufficiently to allow the filler elements to pass by. When the filler element is in place in the enclosure, the extensions snap back into place as shown in the figure, thereby holding the filler elements within the enclosures. It will be appreciated that the spring-like extensions are generally thinner than the web and flange members, although they are shown having the same thickness in the figures. A hydraulic or other tool can be used to press the filler elements into their respective enclosures through the openings.

Figure 2B:
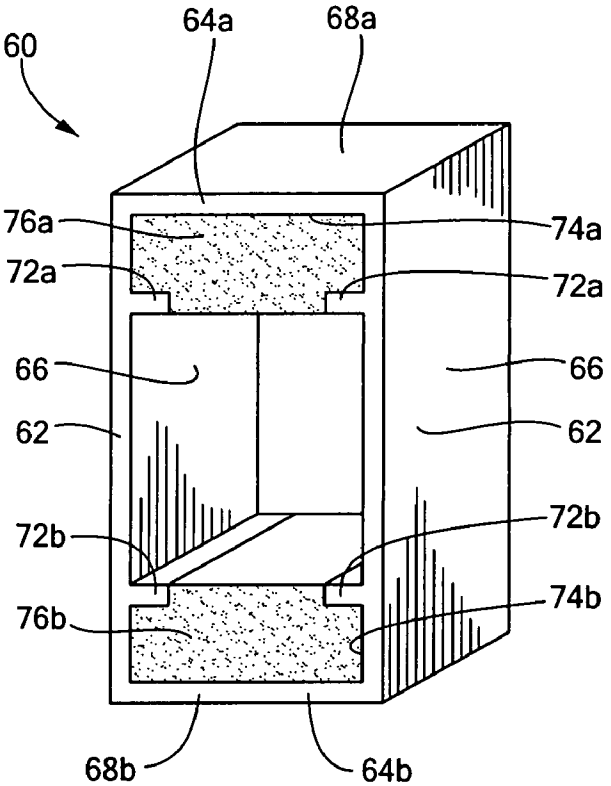
FIG. 2B schematically illustrates an isometric view of the hybrid beam of FIG. 2A having composite material flange filler elements in metal flange enclosures having extensions.
Figure 2A:
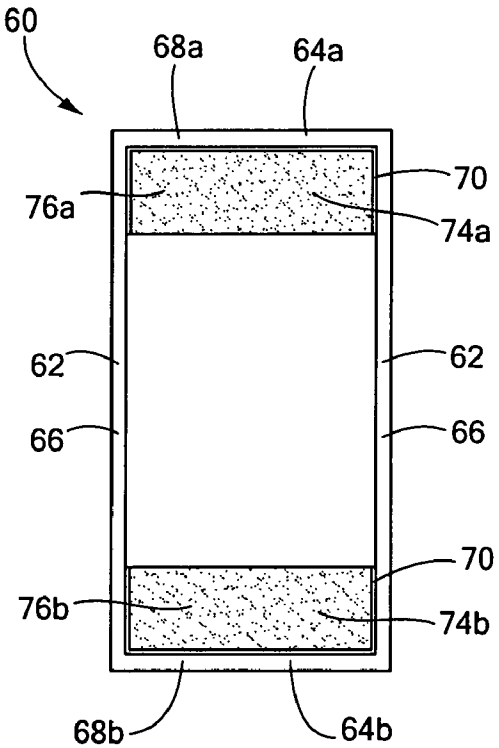
FIG. 2A schematically illustrates an end view of a further embodiment of a hybrid beam having composite material flange filler elements in metal flange enclosures adjacent flange members opening to an interior of the beam.

FIGS. 2A-2G illustrate embodiments in which the flange enclosures for the flange filler elements open to the interior of the beam. Referring first to FIGS. 2A and 2B, the beam 60, of a generally box-like or rectangular cross section, has two web elements 62, an upper flange element 64*a*, and a lower flange element 64*b*. The web elements each have a metal web or depth member 66. The upper flange element includes a metal upper flange member 68*a* extending between ends of the two metal web elements and optionally two metal extensions or tabs 72*d* extending inwardly from the web members (shown in FIG. 2B). The flange member 68*a* and inwardly facing portions of the web members 66, and the two extensions if present, form an upper flange enclosure 74*a*. The lower flange element 64*b* similarly includes a metal lower flange member

68*b* extending between the opposite ends of the two metal web elements and optionally two metal extensions or tabs 72*b* extending inwardly from the web elements (shown in FIG. 2B). The lower flange member and inwardly facing portions of the web members 66, and the two extensions if present, form a lower flange enclosure 74*b*.

An upper flange filler element 76*a* of a composite material is inserted in the upper flange enclosure 74*a*, in contact with the metal inwardly facing surfaces. A lower flange filler element 76*b* of a composite material is inserted in the lower flange enclosure 74*b*, in contact with the metal inwardly facing surfaces. The flange filler elements are fastened to the metal surfaces in any suitable manner, such as with a suitable adhesive 70 (FIG. 2A). The extensions if present hold the filler element in place while the adhesive dries. The filler elements can be slid or press fit into place, or they can be placed into the middle region of the beam and then pressed or snapped into place in the enclosures. In the case of snapping into place, the extensions are spring-like and flexible and thus bend sufficiently to allow the filler elements to pass by. When the filler element is in place in the enclosure, the extensions snap back into place as shown in the figures, thereby holding the filler elements within the enclosures. It will be appreciated that the spring-like extensions are generally thinner than the web and flange members, although they are shown having the same thickness in the figures.

Figure 2E:
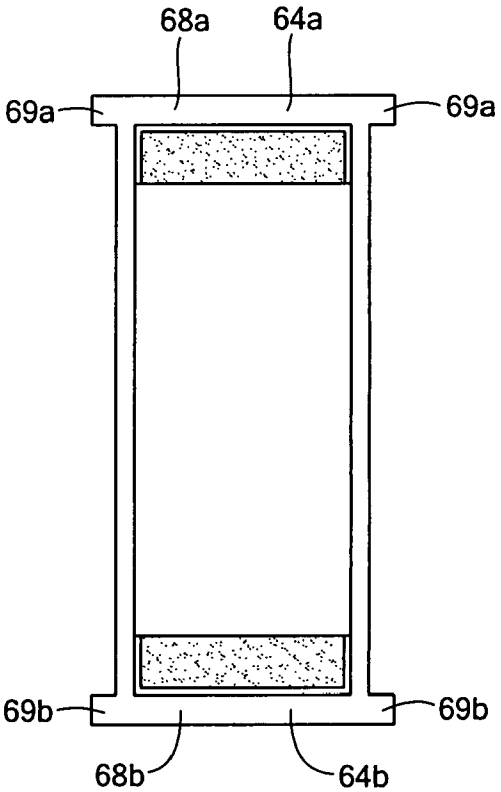
FIG. 2E schematically illustrates an end view of the hybrid beam of FIG. 2A including exterior extensions.
Figure 2D:
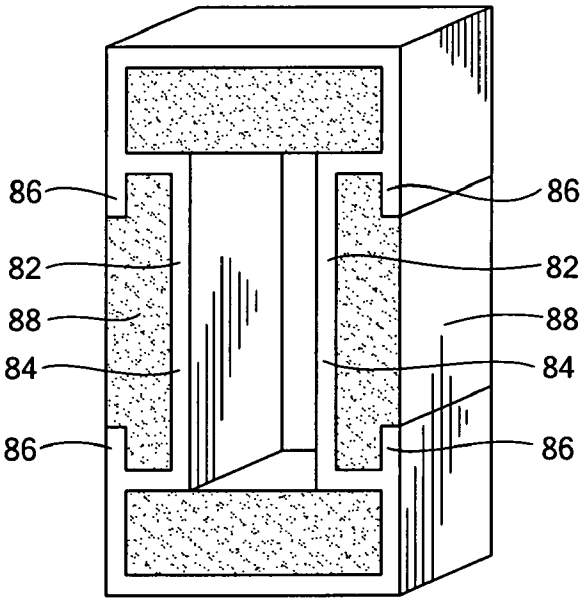
FIG. 2D schematically illustrates an isometric view of the hybrid beam of FIG. 2A further including composite material web filler elements in metal web enclosures having extensions.
Figure 2C:
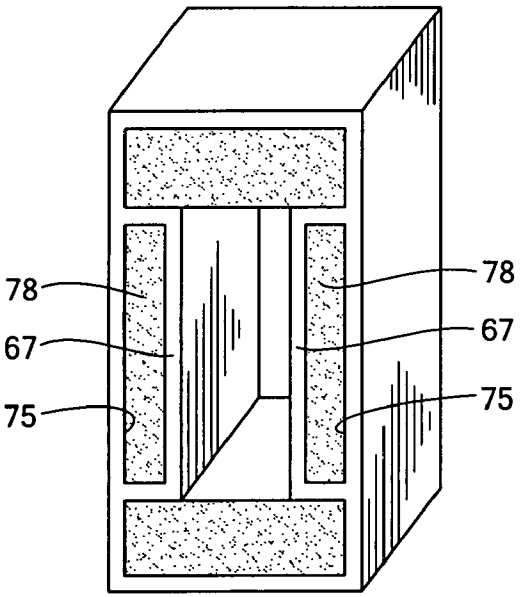
FIG. 2C schematically illustrates an isometric view of the hybrid beam of FIG. 2A further including composite material web filler elements in metal web enclosures.

FIG. 2C illustrates an embodiment similar to FIG. 2A, in which inner metal web members 67 extend between the ends of the extensions to form two web enclosures 75. Web filler elements 78 of a composite material are inserted in the web enclosures, as by sliding or press fitting. The web elements are fastened to the metal surfaces in any suitable manner, such as with a suitable adhesive.

FIG. 2D illustrates an embodiment incorporating web enclosures 82 open to the exterior of the beam. The web enclosures are formed by inner web members 84 and portions of the flange members and optionally extensions 86 aligned with the outer web members. Web filler elements 88 can be slid or press fit into place, or they can be snapped into the web enclosures by pressing them past the extensions. In the case of snapping into place, the extensions are spring-like and flexible and thus bend sufficiently to allow the filler elements to pass by. When the filler element is in place in the enclosure, the extensions snap back into place as shown in the figures, thereby holding the filler elements within the enclosures. It will be appreciated that the spring-like extensions are generally thinner than the web and flange members, although they are shown having the same thickness in the figures. In a further alternative, the web enclosures can be open to the interior of the beam.

FIG. 2E illustrates an embodiment similar to FIG. 2A in which the flange elements 68*a*, 68*b* include flange members 64*a*, 64*b* having extensions 69*a*, 69*b*. The extensions provide a portion upon which fingers can more readily grip to move the beam. FIG. 2F illustrates an embodiment similar to FIG. 2E, in which the flange members 68*a*, 68*b* having longer extensions 71*a*, 71*b*. The longer extensions provide a surface about which nails or spikes may be bent to secure the beams in place, as discussed further below.

Figure 2G:
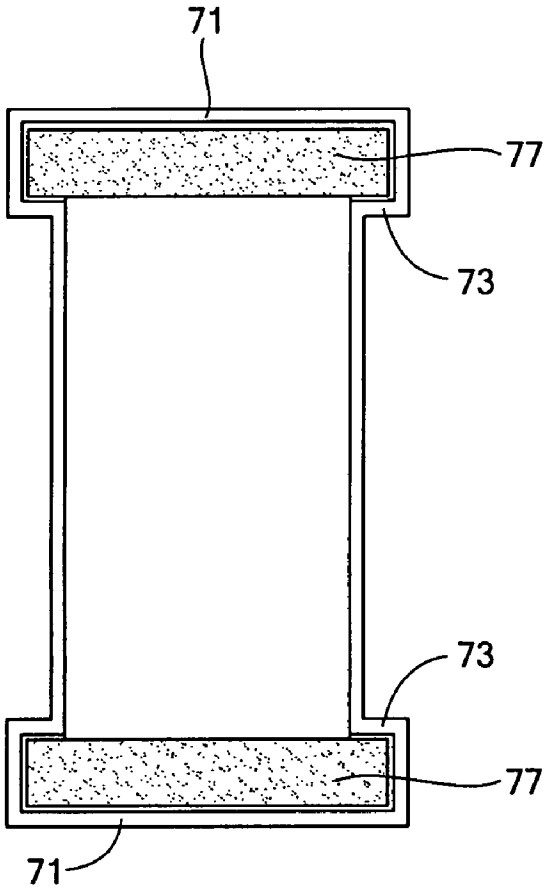
FIG. 2G schematically illustrates an end view of a further embodiment of the hybrid beam of FIG. 2A including extended flange enclosures.
Figure 2F:
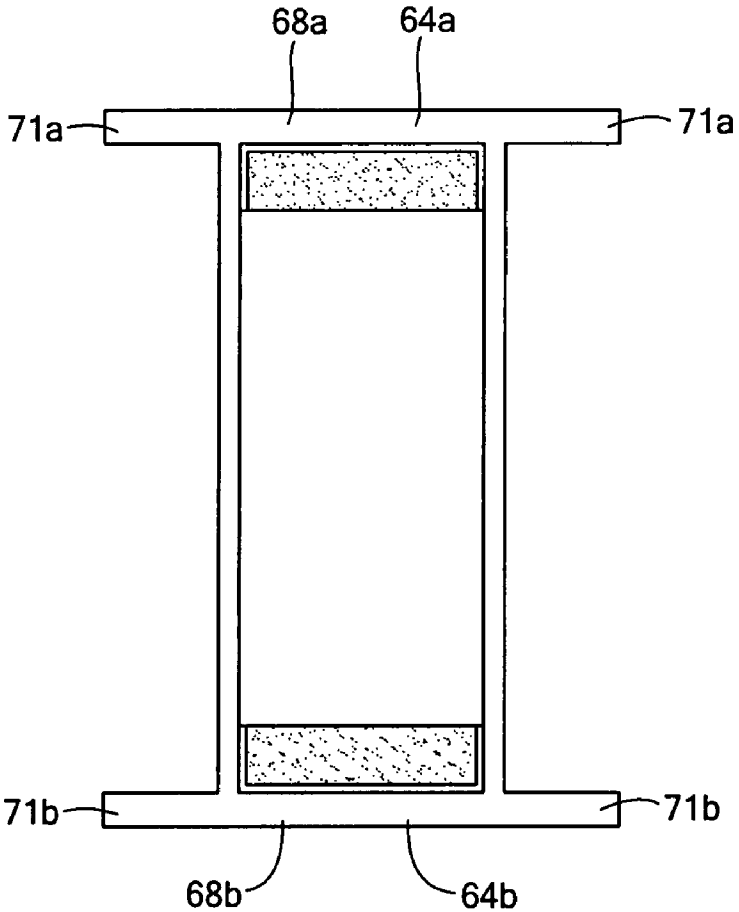
FIG. 2F schematically illustrates an end view of the hybrid beam of FIG. 2E including longer exterior extensions.

FIG. 2G illustrates a further embodiment in which flange enclosures are defined by flange members 71 and 73. Flange filler elements 77 fit within the flange enclosures.

Figure 3C:
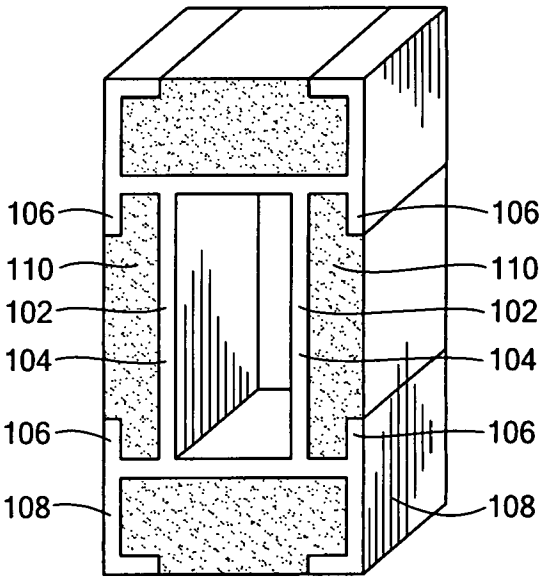
FIG. 3C schematically illustrates an isometric view of the hybrid beam of FIG. 3A further including composite material web filler elements in metal web enclosures having an exterior opening therein.
Figure 3B:
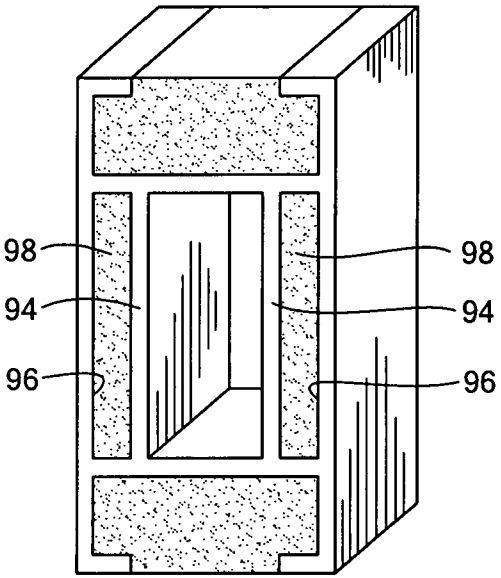
FIG. 3B schematically illustrates an isometric view of the hybrid beam of FIG. 3A further including composite material web filler elements in metal web enclosures.
Figure 3A:
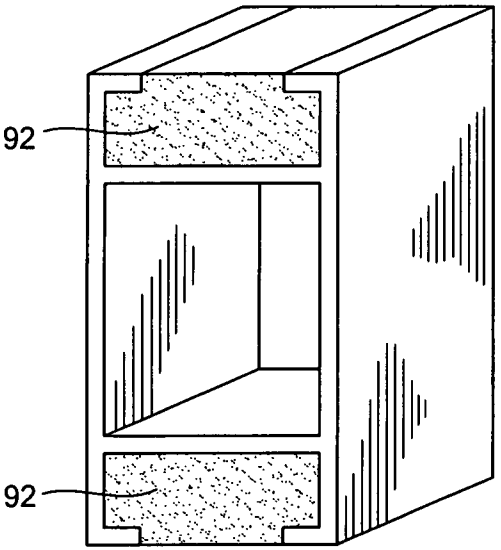
FIG. 3A schematically illustrates an isometric view of a still further embodiment of a hybrid beam having composite material flange filler elements in metal flange enclosures having an exterior opening therein.

FIGS. 3A, 3B, and 3C illustrate still further embodiments in which the flange enclosures for the flange filler elements open to the exterior of the beam. FIG. 3A illustrates an embodiment similar to that of FIG. 2A incorporating flange filler elements 92 of a composite material. The flange filler elements are inserted in the flange enclosures by sliding or press fitting or by snapping past optional spring-like extensions. The flange filler elements are fastened to the metal surfaces in any suitable manner, such as with a suitable adhesive.

FIG. 3B illustrates an embodiment similar to FIG. 3A, in which inner metal web members 94 extend between the flange members to form two web enclosures 96. Web filler elements 98 of a composite material are inserted in the web enclosures, as by sliding or press fitting. The web filler elements are fastened to the metal surfaces in any suitable manner, such as with a suitable adhesive.

FIG. 3C illustrates an embodiment incorporating web enclosures 102 open to the exterior of the beam. The web enclosures are formed by inner web members 104 and optional extensions 106 aligned with the outer web members 108. Web filler elements 110 can be slid or press fit into the enclosures, or they can be snapped into the web enclosures by pressing them past the optional spring-like extensions if present. The web enclosures can alternatively be open to the interior of the beam, as shown in FIG. 1D.

The hybrid beam provides greater fire safety performance than an all-composite material beam. Because there is less composite material present in the hybrid beam of the present invention, less toxic gas is released during a fire. Also, the composite material is encased, either fully or partially, in metal, which delays and reduces and/or eliminates the amount of toxic gas released during a fire.

Figure 5A:
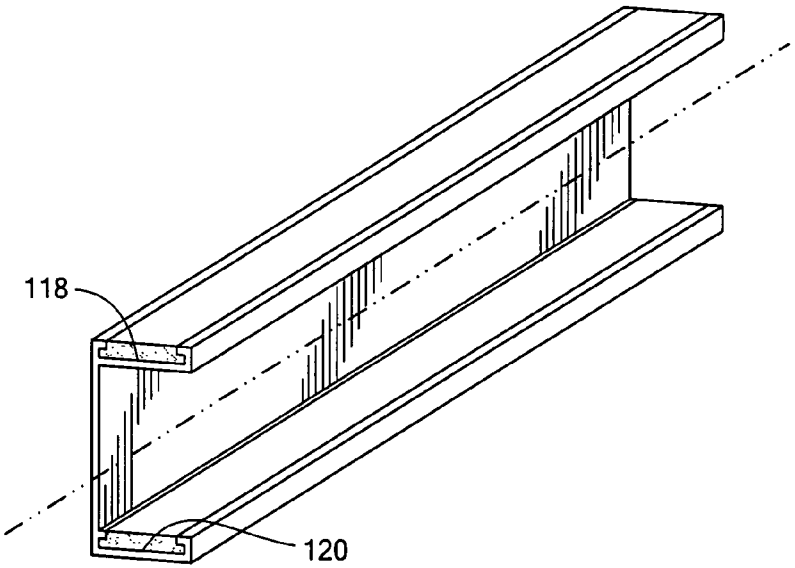
FIG. 5A schematically illustrates two embodiments of a hybrid channel shaped beam with flange filler elements.
Figure 4:
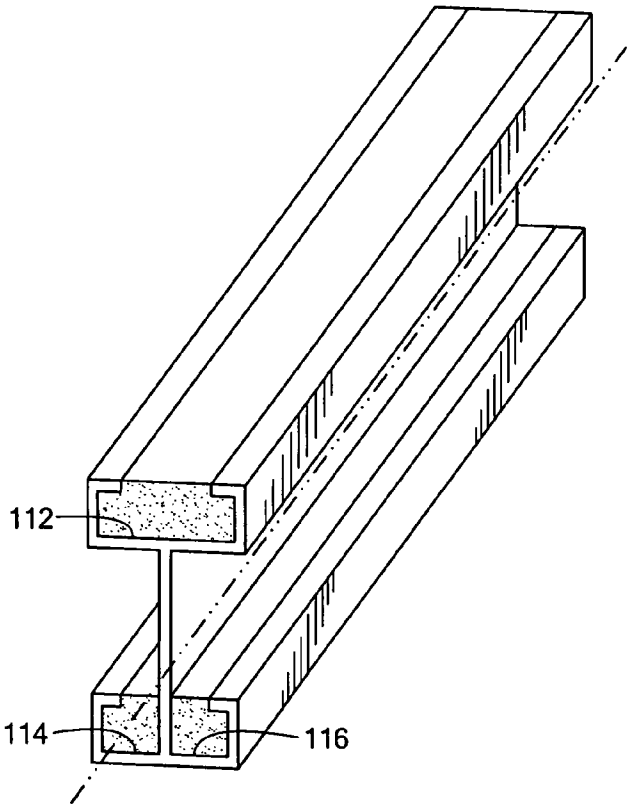
FIG. 4 schematically illustrates two embodiments of a hybrid I-beam with flange filler elements.
Figure 5B:
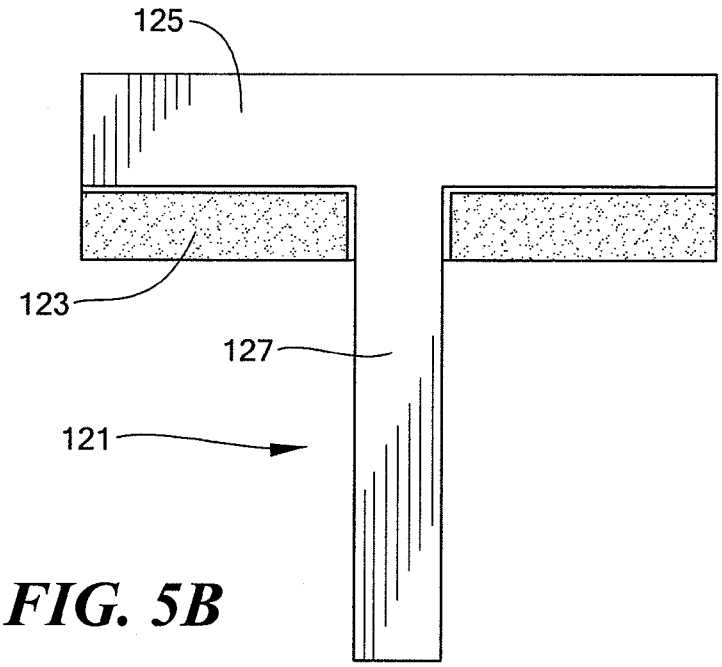
FIG. 5B schematically illustrates an embodiment of a hybrid T-shaped beam with flange filler elements.
Figure 6:
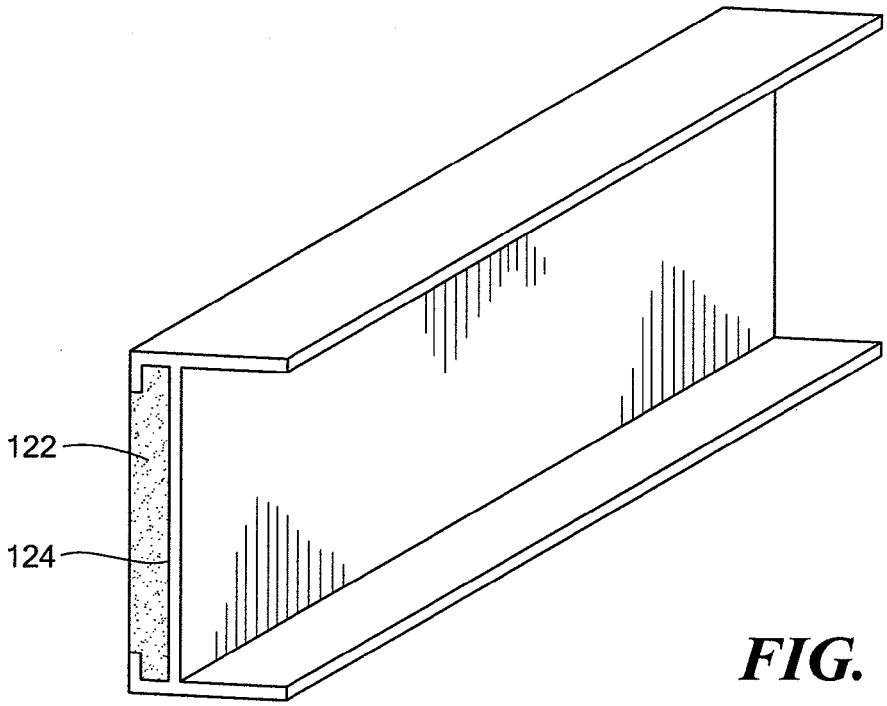
FIG. 6 schematically illustrates an embodiment of a hybrid channel shaped beam with a web filler element.
Figure 7:
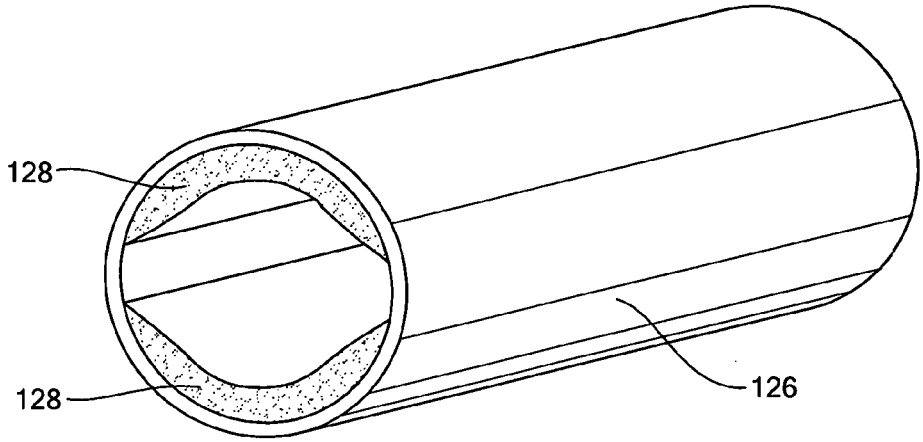
FIG. 7 schematically illustrates a hybrid circular beam with flange or web filler elements.

It will be appreciated that other variations of the hybrid beam of the present invention are contemplated by the present invention. For example, the beam can have an I shape, a C or channel shape, a Z shape, a circular shape, or another configuration, depending on the application. The figures described above illustrate only some of the possible configurations of the beam of the present invention. FIG. 4 illustrates two variations of an I-beam with flange filler elements. Above the dashed line, the beam includes a flange enclosure 112 opening outwardly. Below the dashed line, the beam includes two flange enclosures 114, 116 opening inwardly. FIG. 5A illustrates two variations of a channel shaped beam with flange filler elements. Above the dashed line, the beam includes a flange enclosure 118 opening outwardly. Below the dashed line, the beam includes a flange enclosure 120 opening inwardly. FIG. 5B illustrates a T-shaped beam with flange filler elements 123 below a flange 125 and adjacent a portion of the web 127. FIG. 6 illustrates a channel shaped beam with a web filler element 122 in a web enclosure 124 opening outwardly. FIG. 7 illustrates a beam 126 having a circular cross-section including filler elements 128 along portions of the sides. The filler elements can be considered either web or flange filler elements.

Figure 8:
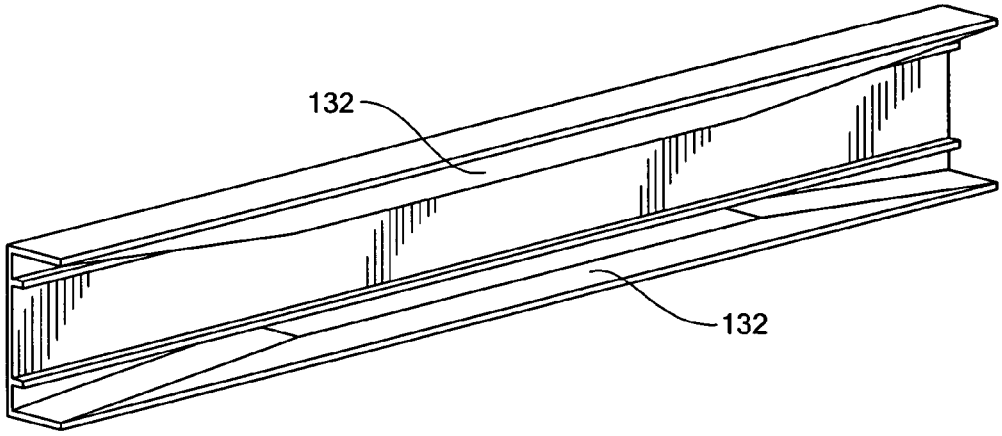
FIG. 8 illustrates a hybrid channel shaped beam with flange filler elements tapering to transfer stresses to the metal component of the beam.

It will also be appreciated that the composite material filler elements do not need to extend the entire length of the beam, but can be placed along those portions of the beam's length where the stresses are determined to be greatest. For example, the filler elements can be placed in the central portion of the length of the beam if that is where the bending stresses are greatest. Also, the filler elements can be stepped or tapered to transition the stress loading to the metal component, as illustrated by the filler elements 132 in FIG. 8. The filler elements can be provided for stiffening and/or strengthening only the web element(s) of the beam and can be omitted from the flange element(s) of the beam, if desired for a particular application.

A hybrid beam according to the present invention can be used in many applications, in horizontal or vertical orientations. For example, the hybrid beam can serve as a vertically oriented stanchion. The hybrid beam can be used for structural and non-structural applications.

Figure 9:
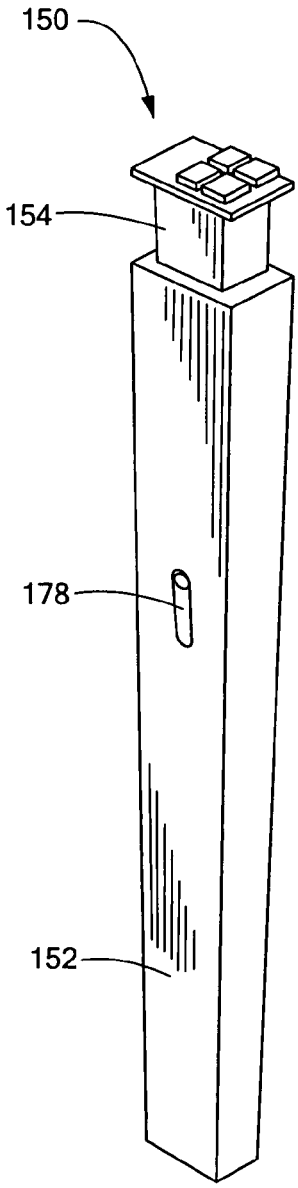
FIG. 9 is a schematic illustration of a stanchion incorporating a hybrid beam according to the present invention.

The hybrid beam can be used in a vertical stanchion assembly for retaining cargo in, for example, a ship's cargo hold, which is subject to motion and various loads. In this case, it is often advantageous to wedge the cargo tightly against vertical stanchions to prevent movement of the cargo. For this application, the stanchion is mounted between a ceiling and a floor. The stanchion assembly 150 includes a stanchion body 152 having a biasing mechanism 154 at one end. See FIG. 9. In this manner, the stanchion assembly can be installed vertically between a floor and a ceiling.

The stanchions can be designed for heavy cargo loading, other specialty cargo loading, or for meeting other requirements, such as in a freezer or chiller location. The stanchion body is formed from a hybrid beam such as described above. The stanchion body includes an external shell, such as of extruded aluminum, having a rectangular cross section, such as 3 inches×6 inches. The shell is internally reinforced on the shorter faces with flange filler elements of a relatively thick unidirectional composite material, such as pultruded graphite/epoxy.

Figure 12:
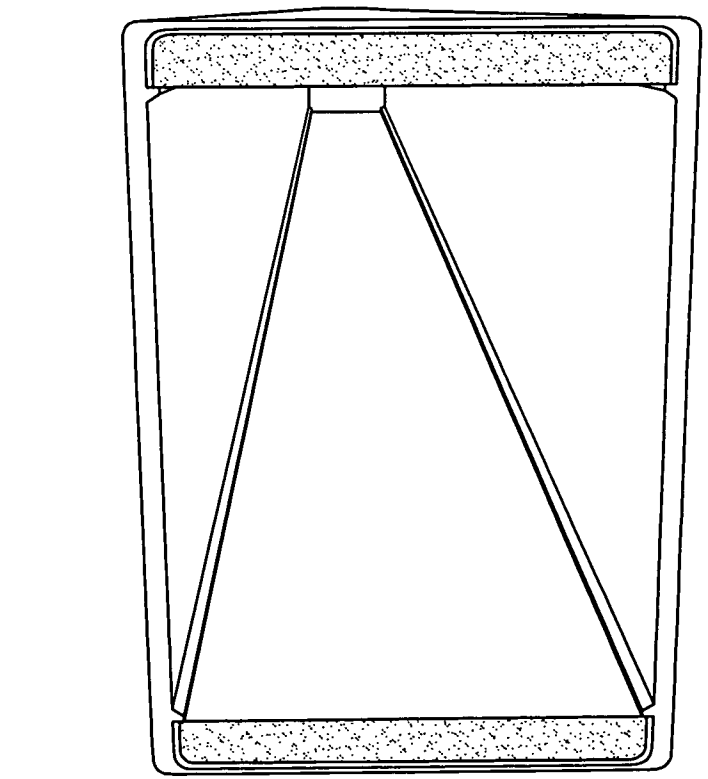
FIG. 12 is a cross-sectional view of another embodiment of a hybrid stanchion body of the present invention.
Figure 11:
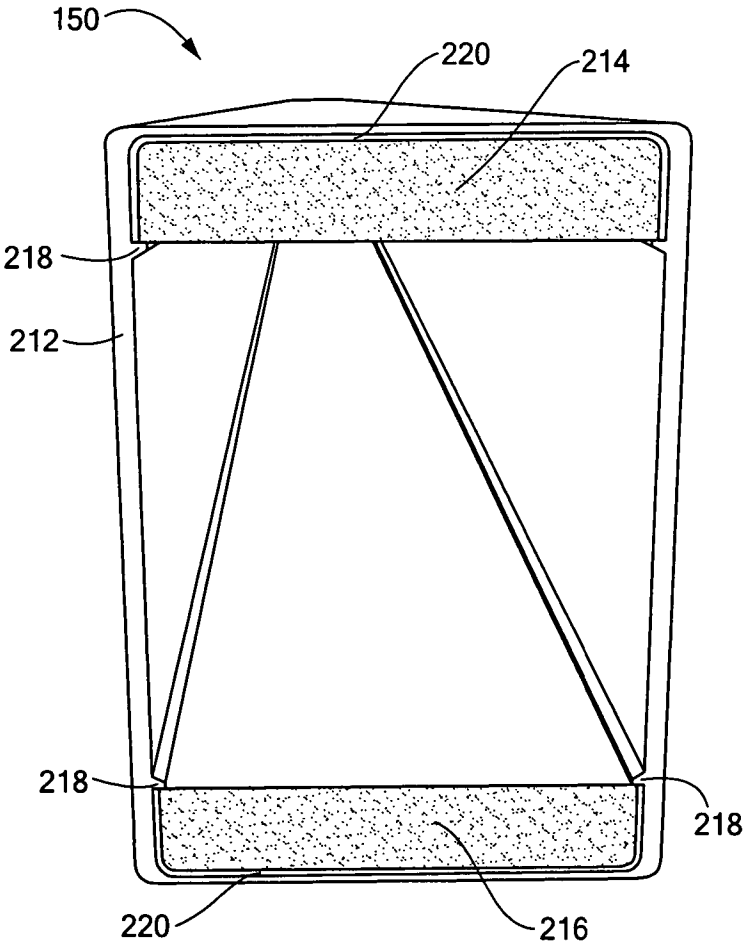
FIG. 11 is a cross-sectional view of one embodiment of a hybrid stanchion body of the present invention.

FIG. 11 illustrates a cross section of a hybrid stanchion body 150 having a metal body 212 of an aluminum extrusion with internally bonded unidirectional carbon-epoxy pultrusions forming flange or web filler elements 214, 216. Small extruded snap tabs or flanges 218 are optionally provided in the aluminum extrusion to support the carbon pultrusion filler elements while adhesive 220 between the filler elements and the metal body sets. FIG. 11 illustrates a greater pultrusion thickness for carrying a greater load, and FIG. 12 illustrates a smaller pultrusion thickness for carrying a lesser load.

This hybrid stanchion body is advantageous in several ways. The external extruded aluminum shell reduces cost. The aluminum improves fire performance by encasing the composite materials in an enclosed, oxygen-limited environment. The aluminum shell also improves abrasion and impact performance and protects the more damage-prone carbon layers. The aluminum shell also improves side-wall shear stiffness without resorting to off-axis carbon fabrics, which can be costly. Also, the aluminum shell serves as "fly-away" captured tooling for the composite construction, wherein the extrusion serves as both mold tooling and part of the finished structure.

The internally bonded carbon/epoxy unidirectional pultrusion filler elements minimize cost by using inexpensive carbon tows, which are generally less expensive than pre-plied carbon broadgoods. The pultrusion also maximizes mechanical properties of the carbon. For example, unidirectional carbon pultrusion has a modulus of 21 msi compared to 10 to 15 msi for suitable composite laminates in an all-composite stanchion body construction. The composite pultrusion reduces the weight of the stanchion body compared to an all-aluminum body. For example, a density reduction of 40% can be achieved. The composite pultrusion eliminates the need for significant material property testing, because unidirectional laminate sees no appreciable non-axial loading. The composite pultrusion is simple to produce by unidirectional plate pultrusions, thus improving production reliability and quality control.

The unidirectional carbon pultrusion can be encased with a thin shell of glass fiber fabric to provide the necessary electrical isolation to prevent potential galvanic corrosion between aluminum and carbon. Fire blocking material such as that available from Avtec can be used for both fire protection and electrical isolation if desired. A fire-suppressing material, such as ATH-alumina hydroxide, can be mixed into the resin, such as epoxy, which has good mechanical properties but lesser fire properties. A resin with better fire properties, such as phenolic resins, can also be used. The aluminum can be anodized to reduce corrosion. The anodized coating type and thickness depend on the selected corrosion standards. The anodized coating can also be colored to enhance identification of beams of different sizes and/or load bearing capacities.

Figure 10:
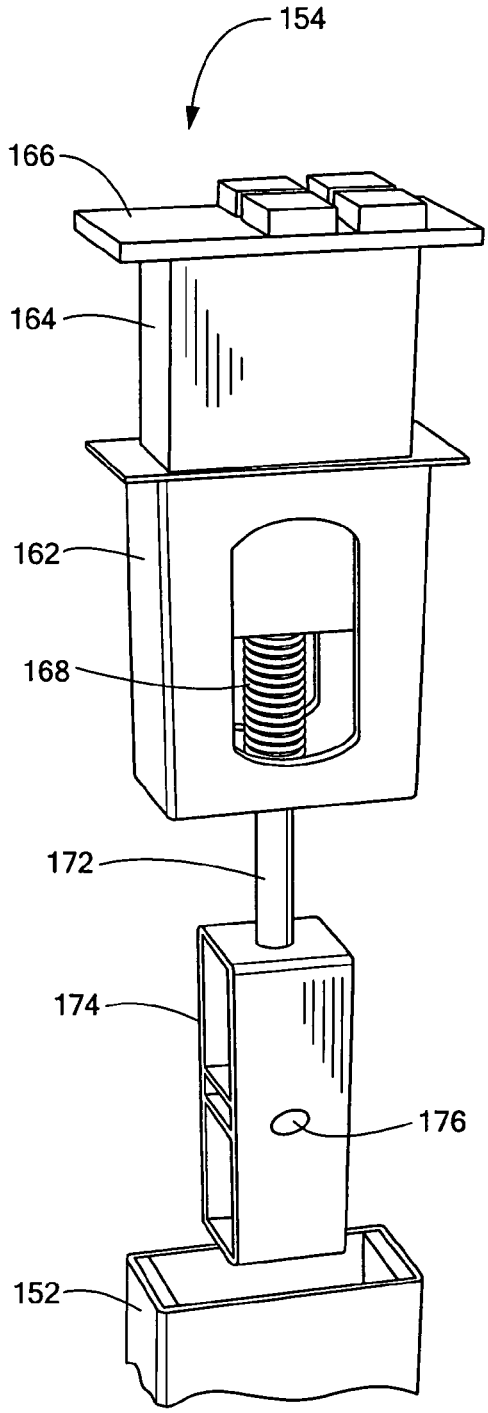
FIG. 10 is an exploded view of a biasing mechanism of the stanchion assembly of FIG. 9.

A suitable biasing mechanism 154 is illustrated with more particularity in FIG. 10. The biasing mechanism includes an insert or sleeve 162 fixed within the upper end of the box beam 152 in any suitable manner. A plunger 164, to which an end cap 166 is fixed, is reciprocally movable within the sleeve. A compression spring 168 within the sleeve biases the plunger upwardly out of the box beam. The spring is coaxially disposed over a spring guide 172 that is fixed in any suitable manner at an upper end to the plunger 164 and at a lower end to an end piece 174 having an aperture 176 therethrough. In an uncompressed position, the end piece is located at an upper end of a slot 178 of the box beam, or a pair of slots on opposed flanges of the box beam. See FIG. 9. A dowel inserted through the slots and the aperture in the end piece allows a user to draw the plunger into the sleeve in the box beam against the bias of the spring. In this manner, the stanchion assembly length can be shortened sufficiently to allow the stanchion to be aligned with a fitting in the ceiling. Any desired spring travel can be accommodated, for example, six inches. Similarly any suitable spring constant can be accommodated, depending on the design requirements. The insert can be lined with a friction-reducing material, such as DELRIN® or high density polyethylene (HDPE) to reduce friction and wear over the life of the stanchion. The materials of the biasing mechanism can be a metal such as aluminum, a thermoplastic material such as glass-fiber-filled PEEK, or another composite material, as determined by the design and cost issues.

Figure 13:
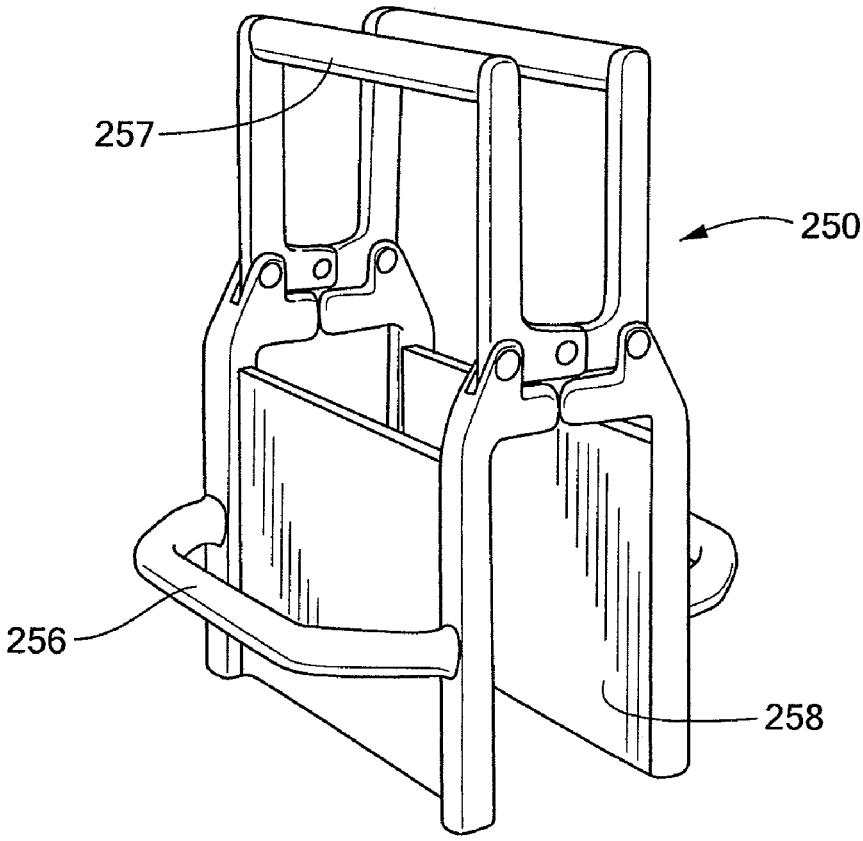
FIG. 13 is a schematic view of a stanchion carrier according to the present invention.
Figure 14:
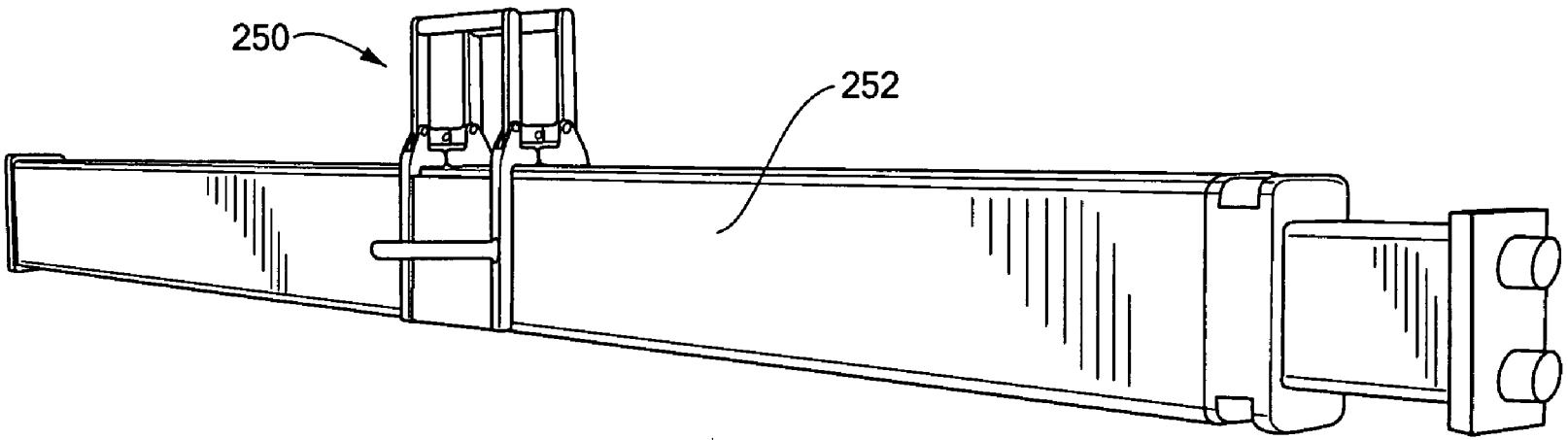
FIG. 14 is a schematic view of the stanchion carrier of FIG. 13 carrying a stanchion.

A stanchion carrier 250 can also be provided. See FIGS. 13 and 14. The stanchion carrier provides an easy way to carry a stanchion 252 from point to point and provides a handle 256 to hold when setting the stanchion in place, particularly if the stanchions are being placed on a ship during rough seas. The carrier includes a collapsible, light weight, composite or aluminum supporting structure in the form of a pair of handles 257. A pair of large, opposed pads 258 are mounted to the supporting structure to be clamped onto a stanchion. A frictional material, such as rubber, covers the opposed surfaces of the pads. The pads distribute the pressure load over a large area of the stanchion and provide considerable area for frictional resistance. The pad material can be selected for good contact in the presence of grit, oil, or other contaminant.

When setting stanchions, the user uses the dowel handle while holding onto one of the carrier handles 256. The dowel handle is inserted and the stanchion is aligned and dropped in place on the deck near the cargo. The stanchion balance point can also be marked during production for the user's reference. A belt loop on the user's belt can be provided to ensure that the folded stanchion carrier is readily available when needed.

In prior art ship-board applications, wooden wedges are driven between the cargo and the stanchions to ensure that the cargo does not move. To prevent the wedges from falling out, spikes are driven into the wedges and, using a hammer, bent around the stanchion to hold them in place. Referring to the embodiment of FIG. 2F, the spikes can be bent around the long extensions 71*a*, 71*b*.

Figure 15:
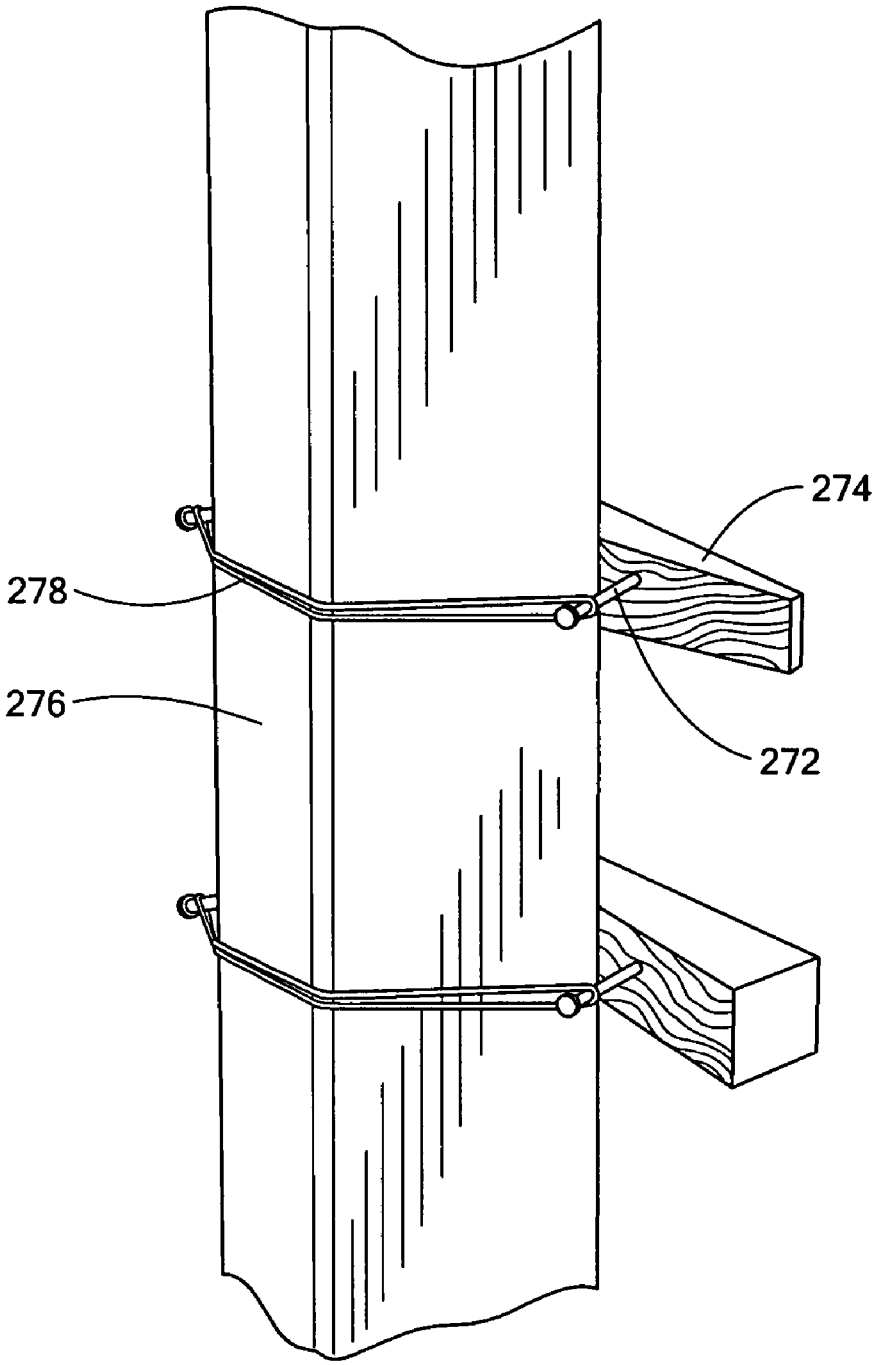
FIG. 15 is a schematic view of a stanchion wedge system of the present invention.

In another aspect of the present invention, spikes 272 are inserted into wooden wedges 274 at approximately a 45° angle on either side of the stanchion 276. A tie 278, such as of nylon, is wrapped around each spike and tightened against the stanchion. See FIG. 15. In this manner, the wedges are retained in place without the need for hammering, which can damage the stanchions.

The invention is not to be limited by what has been particularly shown and described, except as indicated by the appended claims.

What is claimed is:

1. A hybrid beam comprising:

a metal beam component extending in a longitudinal direction from one end to another end, the metal beam component comprising two web elements extending longitudinally, and upper and lower flange elements extending longitudinally, wherein the upper and lower flange elements extend from one web element to the other web element in a box beam configuration;

at least a portion of the web elements and one of the flange elements configured to form a first flange filler enclosure, and at least another portion of the web elements and the other of the flange elements configured to form a second flange filler enclosure;

a composite material component comprising a first filler element disposed within the first flange filler enclosure and a second filler element disposed within the second flange filler enclosure, each of the first and second filler elements comprised of a fibrous material embedded in a matrix material;

a first pair of opposed extensions extending inwardly from the two web elements to retain the first filler element in the first flange filler enclosure;

a second pair of opposed extensions extending inwardly from the two web elements to retain the second filler element in the second flange filler enclosure; and the first and second flange filler enclosures covering at least a portion of an externally facing surface of the composite material component; and a central region of the box beam configuration between the first and second flange filler enclosures free of the composite material component.

2. The hybrid beam of claim 1, wherein the composite material component extends longitudinally within the enclosure from the one end to the other end of the metal beam component.

3. The hybrid beam of claim 1, wherein the composite material component extends along a portion of the length of the metal beam component.

4. The hybrid beam of claim 1, wherein the metal beam component is comprised of a metal or a metal alloy.

5. The hybrid beam of claim 1, wherein the metal beam component is comprised of aluminum or stainless steel.

6. The hybrid beam of claim 1, wherein the fibrous material of the composite material component comprises carbon, glass, or aramid fibers.

7. The hybrid beam of claim 1, wherein the matrix material of the composite material component comprises polyester, vinyl ester, epoxy, phenolic or polyurethane resins.

8. The hybrid beam of claim 1, further comprising an adhesive fixing the composite material component within the enclosure.

9. A stanchion assembly comprising:

the hybrid beam of claim 1; and a biasing mechanism disposed at one end of the hybrid beam comprising an end cap biased outwardly along the longitudinal axis of the hybrid beam.

* * * * *